United States Patent [19]

van Mullekom

[11] 4,450,876

[45] May 29, 1984

[54] METHOD FOR WEAVING ON A WEAVING MACHINE OPERATING WITH A BLOWING NOZZLE FOR A FLOWING TRANSPORT FLUID

[75] Inventor: Hubert P. van Mullekom, Deurne, Netherlands

[73] Assignee: Ruti-te Strake B.V., Netherlands

[21] Appl. No.: 390,850

[22] Filed: Jun. 22, 1982

[30] Foreign Application Priority Data

Jul. 2, 1981 [NL] Netherlands ..... 8103184

[51] Int. Cl.[3] ..... D03D 47/30

[52] U.S. Cl. ..... 139/435; 139/450

[58] Field of Search ..... 139/1 R, 435, 336.4, 139/450; 242/27, 28, 29; 226/97; 66/137 R

[56] References Cited

U.S. PATENT DOCUMENTS 3,236,265 2/1966 Brookshire ..... 139/450

3,598,328 8/1971 Richards ..... 139/224 A 4,362,189 12/1982 Brower et al. ..... 139/336

FOREIGN PATENT DOCUMENTS 1092947 11/1967 United Kingdom ..... 139/450

*Primary Examiner*—Henry Jaudon

*Attorney, Agent, or Firm*—Burns, Doane, Swecker & Mathis

[57] ABSTRACT

The impulse transmission of the transporting fluid to the weft yarn may be different, also with yarns of the same type, through different causes, particularly when a switching takes place from one yarn packet to a next yarn packet. According to the invention this switching is now detected in that the yarn section constituting the connection between both packets moves past a detector which emits a signal whereby the feed pressure for the blowing nozzle launching the weft threads into the weaving shed is temporarily varied.

3 Claims, 1 Drawing Figure

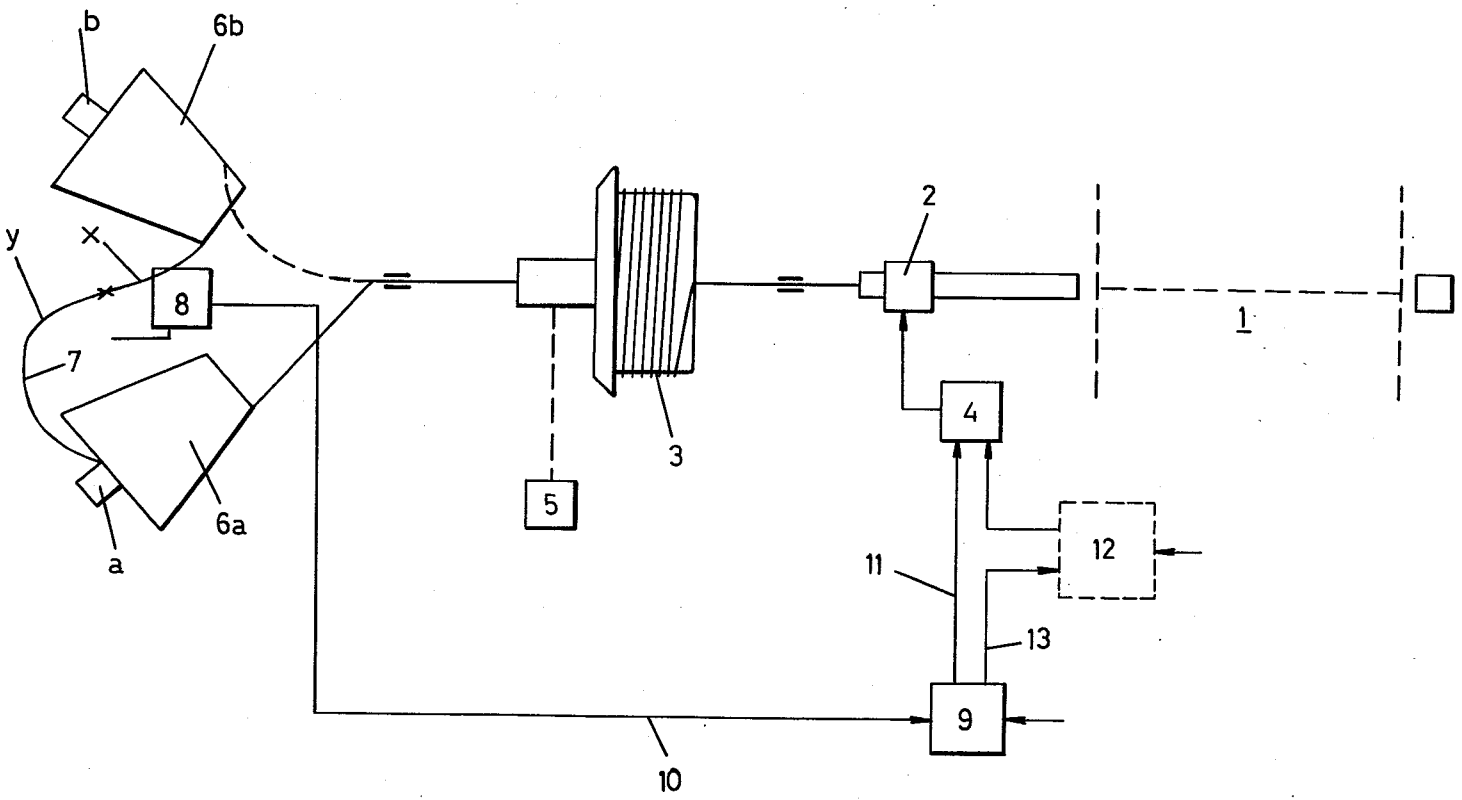
1
2
3
4
5
6a
6b
7
8
9
10
11
12
13
a
b
x
x
y

METHOD FOR WEAVING ON A WEAVING MACHINE OPERATING WITH A BLOWING NOZZLE FOR A FLOWING TRANSPORT FLUID

The invention relates to a method for weaving on a weaving machine operating with a blowing nozzle for a flowing transport fluid, in which the weft threads are measured and withdrawn from successive yarn packets.

In weaving machines in which the transport of the weft yarn through the weaving shed takes place through the intermediary of a flowing fluid, generally air, differences may occur due to different causes in the impulse transmission from the transporting fluid to the weft yarn. So the impulse transmission with smoother yarn is less effective than with the more fibrous yarns. In this case there are clear causes which may be traced back to differences in surface condition with different types of weft yarns. Besides, however, there are also cases in which the causes are less clear, e.g. if differences in weft time are established, which must be attributed to variations in the impulse transmission, with weft threads of the same type of yarn which are transported under seemingly equal circumstances.

Proposals have already been made for compensating the variations in the impulse transmission of the transport fluid to the successive weft threads, occurring with the same type of weft yarn, by automatically adapting the feed pressure of the blowing nozzle and/or automatically adapting the machine number of revolutions, in order thereby to achieve an approximately constant weft time or a weft time which is a substantially constant portion of the momentary weft cycle time which is determined by the number of revolutions. In this connection reference may be made to the proposal described in the Dutch patent application No. 7908357.

Further experiments now have led to the recognition that, beside a more trendlike variation in the impulse transmission, although seemingly spontaneous changes in impulse transmission may occur and that a variation of this last mentioned type particularly may be expected around the moment in which the relative weft yarn packet has been consumed and the switch is made to a next yarn packet which earlier has been arranged by the weaver ready for use in a reserve station of the machine and therefore was tied with its head end to the tail end of the yarn packet being in use. The invention now aims at compensating the influence of the yarn packet change on the weft time interval.

According to the invention this aim is achieved in that the switching to a next yarn packet is detected and as a reaction to the detection signal a temporary change of the feed pressure of the blowing nozzle is caused.

Generally the switching to the reserve yarn packet will tend to temporary increase the weft time so that then in accordance with the proposal of the invention a temporary increase of the feed pressure of the blowing nozzle will have to be applied.

In a practical embodiment the yarn section that constitutes the connection, after the tying together, between the yarn packet being in use and the reserve yarn packet, is placed in a position from which the weft yarn may be withdrawn when the switching to the reserve packet takes place, through a detection zone in the direction of the blowing nozzle.

The invention likewise relates to a weaving machine whereby the method as described above may be performed.

The weaving machine according to the invention comprises at least one blowing nozzle, fed by a flowing transport fluid, for transporting the weft yarn through the weaving shed, and a weft preparation device which measures the successive weft threads and withdraws them from a stationary yarn packet, besides that yarn packet provisions being present for supporting a reserve yarn packet. The machine according to the invention is characterized by a detection device positioned in the zne between those yarn packets in such a position that the yarn section bridging the yarn packets tied together is drawn, when the switching takes place of the packet being in use to the reserve packet, along the detection device, the output of said detection device being connected to the control element for the feed pressure of the blowing nozzle.

The invention is hereunder further illustrated with reference to the schematic drawing of an embodiment given as an example.

In the FIGURE the portion of the weaving machine containing the weaving shed is schematically indicated by the reference number 1. Reference number 2 indicates the blowing nozzle arranged at one end of the weaving shed, to which nozzle on the one hand the weft yarn i is supplied by the weft preparation device 3 and which on the other hand is fed with a flowing fluid, e.g. pressurized air, from a system 4 comprising a source for the relative fluid and the corresponding control means, such as a pressure reduction valve. The drive of the weft preparation device 3 is derived in known manner from the main drive 5 which has been schematically indicated. The device 3 withdraws the weft yarn from a stationary yarn packet *6a* constituted by a cone received on a support shaft a. Beside the yarn packet *6a* a reserve yarn packet *6b* has been provided which is received on a second support shaft b and the head end x of which has been tied to the tail end y of the yarn packet *6a*. Both yarn packets *6a* and *6b* thereby are mutually connected by a yarn section 7.

In the area between the yarn packets an e.g. electrically operated detection device 8 has been provided. The drawing shows the situation in which the yarn section 7 has been placed by the weaver in a leaving position in the detection device 8. As soon as now the yarn packet *6a* has been consumed the yarn section is drawn from the detection device along the yarn path indicated with broken lines and the switch is made to the reserve packet *7b*. Therewith the pick-up (not further shown) of the detection device is passed which generates a signal which is supplied to an electronic circuit 9. Said circuit is adapted to supply, as a reaction to the received signal 10, during a predetermined, if necessary adjustable time interval, a control signal to the system 4. Thereby the pressure reduction valve belonging to the system 4 is adjusted during that time interval to a different, e.g. higher value which likewise may be adjustable in dependence on the yarn to be used and on other parameters.

The drawing further shows an electric control circuit 12 which during normal weaving operation controls the feed pressure of the weft transporting device 2. The influence of said circuit which may be in the embodiment according to the principle as described in the Dutch patent application No. 7908357, may be deleted during the operative period of the circuit 9 thrugh a signal 13 emitted by the circuit 9.

I claim:

1. A method for weaving on a weaving machine operating with a blowing nozzle for a flowing transport fluid, in which weft threads are measured and withdrawn from successive yarn packets, characterized in that the switching to a next yarn packet is combined with a temporary change in the feed pressure of the blowing nozzle.

2. A method according to claim 1 characterized in that the yarn section which, after the typing up, constitutes the connection between the yarn packet being in use and a reserve packet, is placed in a leaving position from which the weft yarn is caused to be withdrawn via a detection zone when switching to the reserve packet takes place.

3. A weaving machine comprising at least one blowing nozzle fed by a flowing transport fluid, for transporting the weft yarn through the weaving shed, and a weft preparation device measuring the successive weft threads and withdrawing them from a stationary yarn packet, in which besides a yarn packet provisions are present for arranging a reserve yarn packet, characterized by a detection device arranged in the zone between both yarn packets in such a position that the yarn section bridging the yarn packets which have been tied together, is drawn, when the switch is made from the packet being in use to the reserve packet, along the detection device, the output of said detection device being connected to the control element for the feed pressure of the blowing nozzle.

* * * * *